US005329433A

United States Patent [19]

Geeting et al.

[11] Patent Number: 5,329,433

[45] Date of Patent: Jul. 12, 1994

[54] LIGHTED JEWELRY BOX

[76] Inventors: David L. Geeting, 1690 El Dorado Dr., Thousand Oaks, 91362; Jeffrey P. Main, 4240 N. Lost Hills Rd. #2805, Agoura Hills, both of Calif. 91301

[21] Appl. No.: 69,509

[22] Filed: Jun. 1, 1993

[51] Int. Cl.[5] ..... F21V 33/00

[52] U.S. Cl. ..... 362/154; 362/155; 16/223

[58] Field of Search ..... 362/154, 155, 394, 135, 362/136, 137; 315/84; 16/223

[56] References Cited

U.S. PATENT DOCUMENTS 2,431,491 11/1947 Lee et al. ..... 362/137
3,553,448 1/1971 Davis et al. ..... 315/84
3,937,320 2/1976 Chao et al. ..... 362/155

*Primary Examiner*—Ira S. Lazarus
*Assistant Examiner*—Sara Sachie Raab
*Attorney, Agent, or Firm*—G. Donald Weber, Jr.

[57] ABSTRACT

An improved jewelry box which incorporates a light source to direct light rays at the jewelry contained therein when the jewelry box is opened. The box consists, generally, of a conventionally-shaped jewelry box with a top section and bottom section. The top and bottom sections are hingedly joined together. A miniature, high-intensity lamp bulb is mounted at the inner surface of the top section. A power source is contained under the jewelry support pad located in the bottom section. An electric switch is incorporated into the hinge about which the top section pivots relative to the bottom section. The switch automatically closes the electrical circuit between the power source and the light source when the box is opened.

11 Claims, 1 Drawing Sheet

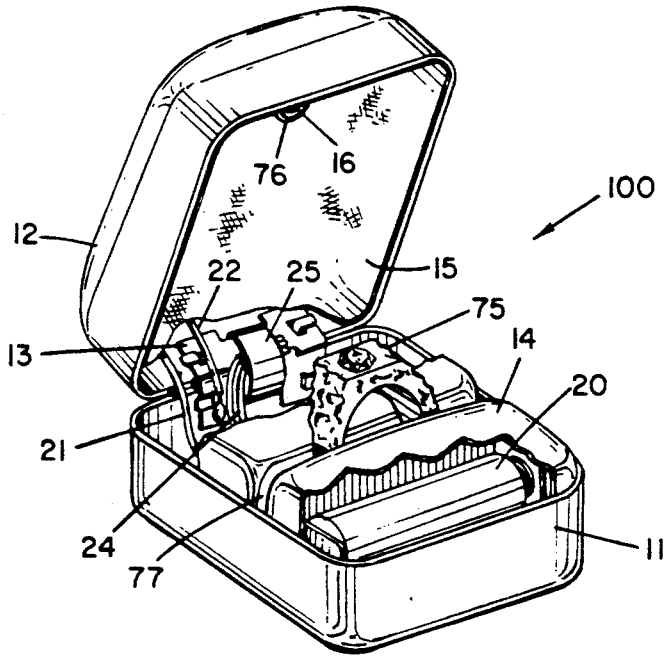
FIG. 1
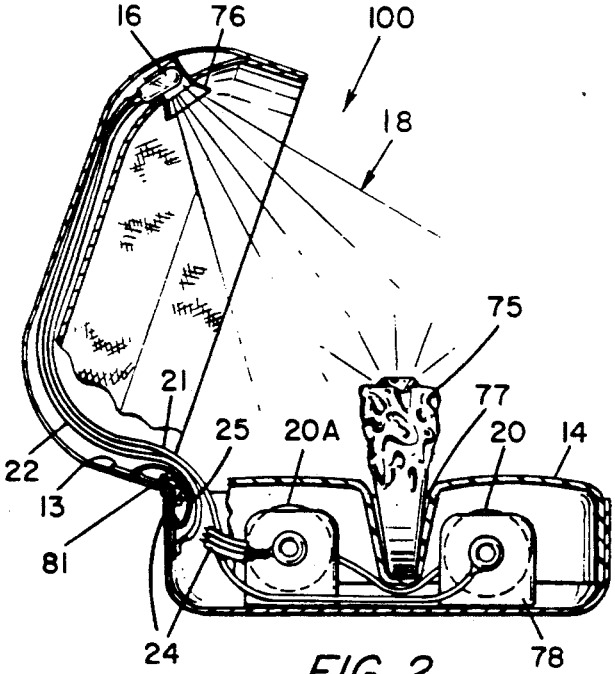
FIG. 2
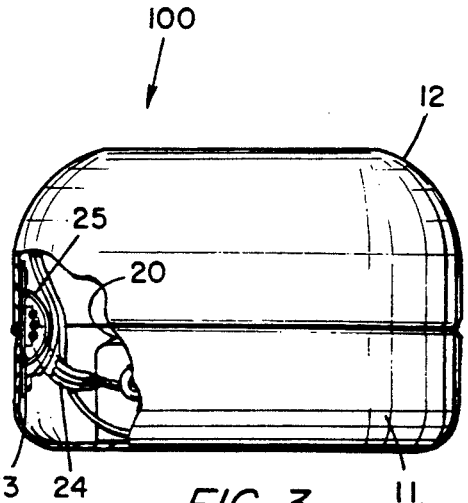
FIG. 3
FIG. 4
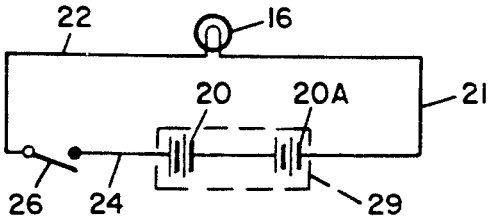

LIGHTED JEWELRY BOX

BACKGROUND

1. Field of the Invention

This invention relates to jewelry boxes, in general, and to illuminated jewelry boxes, in particular.

2. Prior Art

Jewelry boxes are well-known in the art. One particular type of jewelry box is especially adapted to contain a ring or similar item of jewelry. This type of jewelry box has top and bottom sections hingedly joined together. The bottom section of the box is, generally, fairly deep so as to receive and retain a support pad which, in turn, receives and retains at least a portion of a ring. The pad, typically, includes a groove for receiving and retaining at least a portion of the ring. A portion of the ring (as well as the jewel and setting, if any) extends above and is displayed above the support pad.

The top section of the box is, typically, also fairly deep whereby the jewel and setting displayed above the pad are not touched by the top section.

The hinge is, typically, an overcenter hinge which includes a leaf spring. This hinge arrangement is designed to forcefully cause the top and bottom sections to the open or closed position when a certain relative positioning of the sections occurs. Thus, the box is maintained in the open position or is, alternatively, forcefully put in the closed position, i.e. snapped shut, when the top section achieves a nearly closed position.

In some cases, a decorative liner or covering can be used on the exposed inner surfaces of the box. The outside of the box is esthetically treated, as desired.

In the past, attempts have been made to enhance the marketability of jewelry items by making the boxes more attractive. In some cases, an illuminating device has been added to the box. However, in the past these illumination devices have been relatively modest miniature lamps which provide little or no illumination. Likewise, the switch mechanism which activates the light source has been specially designed as an "add-on" to the existing box. The prior art designs have been cumbersome, expensive and, generally, ineffective.

PRIOR ART STATEMENT

The following patents, listed in numerical order, were discovered in a preliminary search.

U.S. Pat. No. 712,112; ILLUMINATED WATCH BOX; C. Arnold. This patent discloses an illuminated watch box.

U.S. Pat. No. 2,159,954; VANITY CASE; W. A. Preisz. This patent discloses an illuminated vanity case.

U.S. Pat. No. 2,453,621; ILLUMINATED COMPACT; 0. W. Chinn. This patent discloses an illuminated compact.

U.S. Pat. No. 2,867,353; DISPLAY BOX FOR WATCHES, ETC.; A. R. Botham. This patent discloses a display box with a transparent section.

U.S. Pat. No. 3,182,184; PURSE LIGHT; D. L. Echols et al. This patent discloses a purse light.

U.S. Pat. No. 3,937,320; LIGHTED JEWELRY BOX; A. L. Chao et al. This patent discloses a lighted jewelry box.

U.S. Pat. No. 4,882,966; MUSICAL JEWELRY BOX; B. Silverman. This patent discloses a musical jewelry box.

U.S. Pat. No. 4,917,459; JEWELRY DISPLAY DEVICE; S. G. Solitt et al. This patent discloses an illuminated jewelry display device.

SUMMARY OF THE INSTANT INVENTION

The present invention provides an improved jewelry box which includes a small, high-intensity electric lamp mounted, along with a reflector, in the top section of the hinged jewelry box. The light is activated when the box is opened and an electrical connection is made through the existing hinge. The electrical connection causes a power source to be electrically connected to the light.

Conversely, when the box is closed, the electrical connection made by the hinge is broken and the light is turned off.

BRIEF DESCRIPTION OF THE DRAWINGS

FIG. 1 is a partially broken away, front perspective view of the lighted jewelry box of the instant invention shown with the cover opened.

FIG. 2 is a cross-sectional side view of the instant invention taken along the lines 2—2 of FIG. 1 with the lamp illuminating a jewelry item.

FIG. 3 is an enlarged cross-sectional side view of the instant invention in the closed position and showing the switch structure.

FIG. 4 is a schematic diagram of the electric circuit of the instant invention.

DESCRIPTION OF A PREFERRED EMBODIMENT

Referring now to FIG. 1, there is shown a partially broken away, front perspective view of the instant invention. A lighted jewelry box 100 includes a bottom section 11 and a top section 12 pivotally attached together by a hinge 13. The interior of the bottom section is fitted with a pad 14 upon which ring 75 or some other jewelry item is placed. In a preferred embodiment, the pad 14 includes a groove 77 which receives at least a portion of ring 75. The pad 14 may be a plastic or cardboard insert to provide support for the ring. The upper surface of pad 14 can be treated in a suitable manner to give a luxuriant appearance, if so desired. The interior of the top section 12 is, typically, lined with silk, rayon or other shiny fabric liner 15. The bottom section 11 and top section 12 are usually made of hard plastic material. The outer surface thereof can be treated in a suitable manner to be aesthetically pleasing.

In the instant invention, the above-described box 100 includes a miniaturized, high-intensity electric lamp 16 and reflector 76 mounted to the top section 12. Typically, the lamp 16 extends into the reflector 76. The reflector 76 passes through a small opening in the liner 15. The lamp 16 and reflector 76 can be mounted to the inner surface of top section 12 or to the liner 15. The lamp 16 is electrically powered by a suitable electrical source, for example, one or more dry cell batteries 20 that are mounted out of sight under the insert 14. With this arrangement, the lamp/reflector combination causes light rays to shine downwardly upon the ring 75 or other jewelry item when the lamp is energized.

Referring now to FIG. 2, there is shown a cross-sectional view of the jewelry box 100 of the instant invention. In FIG. 2, components similar to those shown in FIG. 1 bear similar reference numerals.

In this embodiment, the batteries 20 and 20A are disposed on either side of the groove 77 in the pad 14. The batteries 20 and 20A are connected to each other (typically, in parallel) by a suitable mounting bracket 78. One end of the mounting bracket 78 is electrically connected to the anodes of the batteries. The other end of the bracket is connected to the cathodes of the batteries. One end of bracket 78 is, also, connected directly to the lamp 16 by means of wire conductor 21. Conversely, conductor 22 is connected from lamp 16 to a portion of hinge 13 which is connected to the top and bottom portions of box 100. In this embodiment, hinge 13 is made of electrically conductive material.

one end of conductor 24 is connected to the other end of the bracket 78. The other end of conductor 24 is mounted between the hinge 13 and the closure spring 25. A suitable insulation 81 is provided between conductor 24 and hinge 13 to prevent electrical contact therebetween.

In one embodiment, conductor 24 comprises a flat cable (or multiple contiguous wires). In this embodiment, the insulation is removed from only one side thereof. The insulated side of the cable is adhered to the hinge 13 in any suitable fashion, e.g. by glue. The bared side of the conductor 24 is placed face out toward clip 25. In the open condition of the box, as shown in FIG. 2, the clip 25 is stretched and contacts the bared wire end of conductor 24. This contact completes the electrical circuit between the batteries and the lamp 16. Thus, lamp 16 causes light rays 18 to shine on ring 75.

Referring now to FIG. 3, there is shown detailed view of the hinge portion of the box 100. As shown in FIG. 3, the hinge 13 joins the top section 12 and bottom section 11 of box 100. When the box is closed, the spring clip 25 flexes inwardly into box 100 and away from hinge 13 and conductor 24. Thus, spring clip 25 does not contact conductor 24. Therefore, the electrical circuit between the electrical source (i.e. batteries 20) and lamp 16 is broken.

Thus, conductor 24 is arranged to selectively make electrical contact with spring 25. That is, in the closed position of the box, spring 25 is normally spaced away from the conductor 24. However, in the open position of box 100, spring 25 is flexed or stretched whereby it makes contact with the conductor 24 and completes the electrical circuit. Thus, when box 100 is closed, the wire 24 and spring 25 do not make electrical contact with each other. Conversely, when the box 100 is open, the wire 24 and spring 25 make contact.

In operative use, when the top section is pivoted upward, the spring clip 25 is stretched from the position shown in FIG. 3 to the position shown in FIG. 2, thus closing the electric circuit and energizing the lamp 16 which shines upon the jewelry.

As shown, in any of the Figures, the hinge 13 can be covered by liner 15 and insert 14 for esthetic purposes. In addition, the liner 15 covers the conductors 21 and 22. In similar fashion, insert 14 covers conductor 24.

Referring now to FIG. 4, there is shown a schematic diagram of the electrical circuit of the instant invention. The light source 16 (i.e. light bulb) is directly connected to the power source 29 (i.e. batteries 20 and 20A) via conductor 21. Also, light source 16 is connected to one side of the schematically shown switch 26 via conductor 22. The power source 29 is connected to the other side of switch 26 by the conductor 24. The switch 26 includes the hinge 23 and the flexible spring clip 25, as shown and described supra. Depending upon the position of the top section 12 and, thus, spring clip 25, the switch 26 is electrically open or closed.

Thus, there is shown and described a unique design and concept of a jewelry box. The particular configuration shown and described herein relates to a jewelry box which lights up upon being opened. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A lighted box comprising,
a bottom section,
a top section,
hinge means connecting said bottom section with said top section,
said hinge formed of electrically conductive material,
a miniature lamp located within said top section for selectively illuminating at least said bottom section,
power source means contained in said bottom section,
first conductor means connected from said miniature lamp to said power source means,
second conductor means connected from said miniature lamp to said hinge means,
third conductor means connected from power source means and disposed adjacent to said hinge means in a non-conductive manner, and
a spring clip means connected to said hinge means whereby when said top section is pivoted to an open position to allow access to the inside of the box, said spring clip means is stretched to contact said third conductor and complete an electrical circuit path between said lamp and said power source.

2. The box recited in claim 1 including,
an insert fitted within said bottom section for supporting an item.

3. The box recited in claim 1 including,
a fabric lining mounted at the inner surface of said top section.

4. The box recited in claim 1 wherein,
said lamp comprises a high intensity light bulb.

5. The box recited in claim 1 wherein,
said spring clip means flexes away from said third conductor means and opens the electrical circuit path between said lamp and said power source when the top section of said box is pivoted to a closed position.

6. The box recited in claim 1 including,
reflector means mounted in said top section adjacent said miniature lamp.

7. The box recited in claim 6 wherein,
said miniature lamp extends into said reflector means.

8. The box recited in claim 1 wherein,
said power source comprises a battery.

9. The box recited in claim 2 wherein,
said insert includes a groove therein for receiving at least a portion of said item.

10. The box recited in claim 3 wherein,
said fabric lining is formed of a shiny fabric.

11. The box recited in claim 1 including,
mounting bracket means for supporting said power source means.

* * * * *